US005993092A

United States Patent [19]

Palmer

[11] Patent Number: 5,993,092

[45] Date of Patent: Nov. 30, 1999

[54] PRINTER WITH REVERSIBLE RIBBON DRIVING MEANS FOR REWINDING OVERSHOT RIBBON

[75] Inventor: Anthony James Palmer, Betchworth, United Kingdom

[73] Assignee: ITW Limited, Surrey, United Kingdom

[21] Appl. No.: 09/028,054

[22] Filed: Feb. 23, 1998

[30] Foreign Application Priority Data

Feb. 26, 1997 [GB] United Kingdom ..... 9703955

[51] Int. Cl.[6] ..... B41J 33/36; B41J 33/40; B41J 33/44

[52] U.S. Cl. ..... 400/234; 400/232

[58] Field of Search ..... 400/232, 234, 400/223

[56] References Cited

U.S. PATENT DOCUMENTS

| | | | |
|---|---|---|---|
| 4,675,698 | 6/1987 | Tsutsumi | 400/120 |
| 4,712,113 | 12/1987 | Brooks et al. | 400/234 |
| 5,181,788 | 1/1993 | Norman, Jr. et al. | 400/225 |
| 5,433,539 | 7/1995 | German | 400/234 |
| 5,533,819 | 7/1996 | Watanabe et al. | 400/225 |
| 5,647,679 | 7/1997 | Green et al. | 400/224.1 |
| 5,700,096 | 12/1997 | Satoh et al. | 400/232 |
| 5,711,623 | 1/1998 | Nose | 400/225 |
| 5,816,719 | 10/1998 | Palmer | 400/232 |

FOREIGN PATENT DOCUMENTS

| | | |
|---|---|---|
| 0 734 876 | 10/1996 | European Pat. Off. . |
| 0 861 735 | 9/1998 | European Pat. Off. . |
| 2 289 444 | 11/1995 | United Kingdom . |

OTHER PUBLICATIONS (1) European Search Report with Annex and English Language Abstract of EP 97309683.

(2) English Language Abstract of Japan Publication No. 60 187580.

(3) English Language Abstract of Japan Publication No. 63 071382.

*Primary Examiner*—Ren Yan
*Assistant Examiner*—Daniel J. Colilla
*Attorney, Agent, or Firm*—Lowe Hauptman Gopstein Gilman & Berner

[57] ABSTRACT

A thermal printer for printing on a continuous print medium by ink transfer from a thermal print ribbon has a print head which is pivotally mounted and which is driven in an oscillatory nodding motion by means of a stepper motor so as repeatedly to bring a linear array of energizable printing elements to bear against a platen roller. Both the element array and the platen extend transversely to respective paths of travel of the print medium and the ribbon. The print medium is fed through the printer from an inlet region, between the platen and print head, and thence to an outlet region. The instantaneous rate of travel of the print medium past the print head is substantially the same as the rate of feed of print medium to the printer. Typically this rate is of the order of 250 to 400 mm per second. The ribbon also travels between the print head and the platen, overlying the print medium and is driven in such a manner that it travels at the same rate as the print medium during each printing operation. Between each printing operation the ribbon is driven in reverse to rewind any unused portion of ribbon which has overshot the printhead.

18 Claims, 3 Drawing Sheets

PRINTER WITH REVERSIBLE RIBBON DRIVING MEANS FOR REWINDING OVERSHOT RIBBON

TECHNICAL FIELD

This invention relates to a thermal printer for printing on a continuous print medium by thermal ink transfer from a print ribbon.

BACKGROUND ART

It is known to print continuous packaging material and other continuous print media such as label bearing substrates with alphanumeric information and other symbols using a thermal transfer printer. A print head having a row of electronically driven heating elements is brought to bear against an ink-carrying thermal transfer ribbon lying over the print medium while the print medium is driven perpendicularly to the row of print elements. In one known printer, the ribbon is supplied from a take-off spool and then passes along a ribbon path which extends between the print head and the path of the print medium, and thereafter is fed onto a take-up spool, the ribbon travelling across the print head at at least approximately the same speed as the print medium whilst printing is taking place. The path followed by the print medium extends around movable rollers which deflect the print medium by variable amounts both upstream and downstream of the print head. The ribbon drive mechanism has considerable "inertia"; both true mechanical inertia in the drive mechanism and that resulting from delays in the control system which starts and stops the mechanism. This inertia causes ribbon wastage since gaps are left between successive used areas of the ribbon.

It is an object of this invention to provide a printer for continuous printing which makes more efficient use of ribbon.

SUMMARY OF THE INVENTION

According to a first aspect of this invention there is provided a thermal printer for printing on a continuous print medium by ink transfer from a thermal print ribbon. A print medium path extends between inlet and outlet regions of the printer. A platen extends transversely of the path. A thermal print head having energisable print elements is located in an opposing relationship with respect to the platen on the other side of the print medium path from the platen. A ribbon path between the print head and the platen runs in the same direction as, and lies adjacent to, the print medium path. A printing actuator is operable to bring the print head and the platen together in successive printing operations. A ribbon drive is operable to drive the ribbon along the ribbon path in a first direction at variable rates during printing operations, and to drive the ribbon between printing operations; in a second direction opposite to the first direction.

By driving the ribbon in the second direction, the gaps left in ribbon usage due to drive mechanism inertia are virtually eliminated. Over many printing operations, this results in significant savings in ribbon usage and therefore in printer running costs.

Preferably, the ribbon speed during each printing operation is variable in response to the print medium speed of travel so as to match the speed with which the print medium is fed past the print head. This may be achieved, for example, by forming the platen as a roller around which the print medium is wrapped so that the speed of rotation of the roller is a measure of the speed of passage of the print medium. A shaft encoder, typically an optical encoder, is used to provide an input to processing means forming part of the printing actuator to control movement of the print head and energisation of the printing elements. In addition, the ribbon may be driven by a stepper motor coupled to a ribbon drive roller, the speed of operation of the stepper motor being governed by the sensed speed of rotation of the platen roller.

The speed and duration of ribbon movement in the second direction is preferably adjusted so that the unused portion of the ribbon immediately adjacent the portion used in the previous printing operation is beneath the printhead ready for the next printing operation. The result sought is to move the ribbon back by a length equal to the unused portion caused by the drive inertia. In an embodiment using a stepper motor for ribbon driving, the length required is equivalent to a predetermined number of steps of the motor.

In practice, the length of ribbon which must be reversed varies at least with the operational speed of the printer since typically the speed of ribbon drive varies with printer speed which causes the magnitude of ribbon drive overshoot to vary. Thus the ribbon drive is preferably operable to drive the ribbon in the second direction until a predetermined length of ribbon has been reversed past the printhead. The predetermined length may be varied in response to the speed of ribbon driving in the first direction.

Typically, the ribbon drive is operable to reverse the ribbon just less than the unused portion of the ribbon to allow an error margin and ensure that printing does not recommence on a used part of the ribbon.

In this way it is possible to operate the printer over a wider range of speeds than prior art printers, with the print medium passing the print head at substantially the same rate as it is fed to and extracted from the printer. Typically, the printer is capable of operating at print medium speeds up to 400 mm per second.

According to a method of the invention, a method of printing on a continuous print medium comprises the steps of providing a printer having a print head with energisable print elements, and a platen, the print head and the platen being located in an opposing relationship with respect to each other. The print medium is fed to the printer at a continuous feed rate and passes it between the print head and the platen in the same direction as, and adjacent to, the print medium. A print ribbon is fed between the print head and the platen periodically. The print head and the platen are periodically brought together and the print elements with the ribbon in contact with the print medium are energised to cause transfer of ink from the ribbon to the print medium in a printing operation. The print medium is passed between the print head and the platen at a rate corresponding to the rate at which the print medium is fed to the printer during and between successive printing operations. During each printing operation, the ribbon is passed in a first direction between the print head and the platen in contact with the print medium, the rate at which the ribbon moves during the printing operation being variable in response to the rate of travel of the print. medium in the printer. Between printing operations, the ribbon is moved in a second direction which is the reverse of the first direction.

The ribbon path may be defined by guides and, between the print head and the platen, runs in the same direction as, and lies adjacent to, the print medium path. The printing actuator is operable to move the print head towards and away from the platen in successive printing operations, to compress the ribbon and the print medium together along a line of printing elements on the printing head. The print head may be mounted on a print head carrier which is pivotable about an axis running transversely to the print medium path, the print elements being spaced from this axis to execute the above-mentioned movement towards and away from the platen as a nodding motion.

Advantageously, the print head carrier is linked to the shaft of a stepper motor coupled to the printing actuator, with the printing elements spaced from the axis of rotation of the motor so that they follow an arcuate locus which passes through the surface of the platen roller at a location where it supports the print medium. Operation of the stepper motor over a small angular range successively in opposite directions moves the print head towards and away from the platen roller at the beginning and end respectively of each successive printing operation. Rigid coupling of the print head carrier to the motor shaft (e.g. by means of cranks and a connecting rod or by direct co-axial connection) results in accurate positioning of the print head elements with respect to the print medium as it travels over the platen roller and with respect to the platen roller axis of rotation.

The invention also includes, according to a third aspect thereof, a printer for printing on a continuous print medium by ink transfer from a print ribbon, comprising means defining a print medium path, a platen extending transversely of the path, a print head having energisable print elements and located in an opposing relationship with the platen on the other side of the print medium path from the platen, means defining a ribbon path which, between the print head and the platen, runs parallel with and lies adjacent the print medium path, a ribbon take-off spool, a ribbon take-up spool which is belt driven via a slipping clutch drive, reversible ribbon driving means and a printing actuator operable to bring the print head and the platen together in successive printing operations.

The printer may further comprise a ribbon drive pulley located in the ribbon path between the print head and the take-up spool, and a ribbon drive motor coupled to the drive pulley, the take-up spool being belt-driven by the motor. The take-up spool may be belt-driven directly from the print medium or from the roller driven by the passage of the print medium. Thus, the belt drive may include a driven roller arranged to bear against either the print medium where it lies over the platen or an alternative supporting surface, or against a roller which is rotated by the passage of the print medium. The driven roller may be mounted on the print head carrier so as to drive the take-up spool only during a print operation, i.e. when the print head bears against the ribbon, the print medium and the platen.

The invention is applicable primarily to printing variable information on continuous plastics film packaging material, with each print operation being triggered by, for example, sensing the position of products to which the packaging material is to be applied as they travel along an adjacent conveyor. Typically, the information includes sell-by dates, serial numbers, pricing information, and bar codes.

BEST MODE FOR CARRYING OUT THE INVENTION

Figure 1:
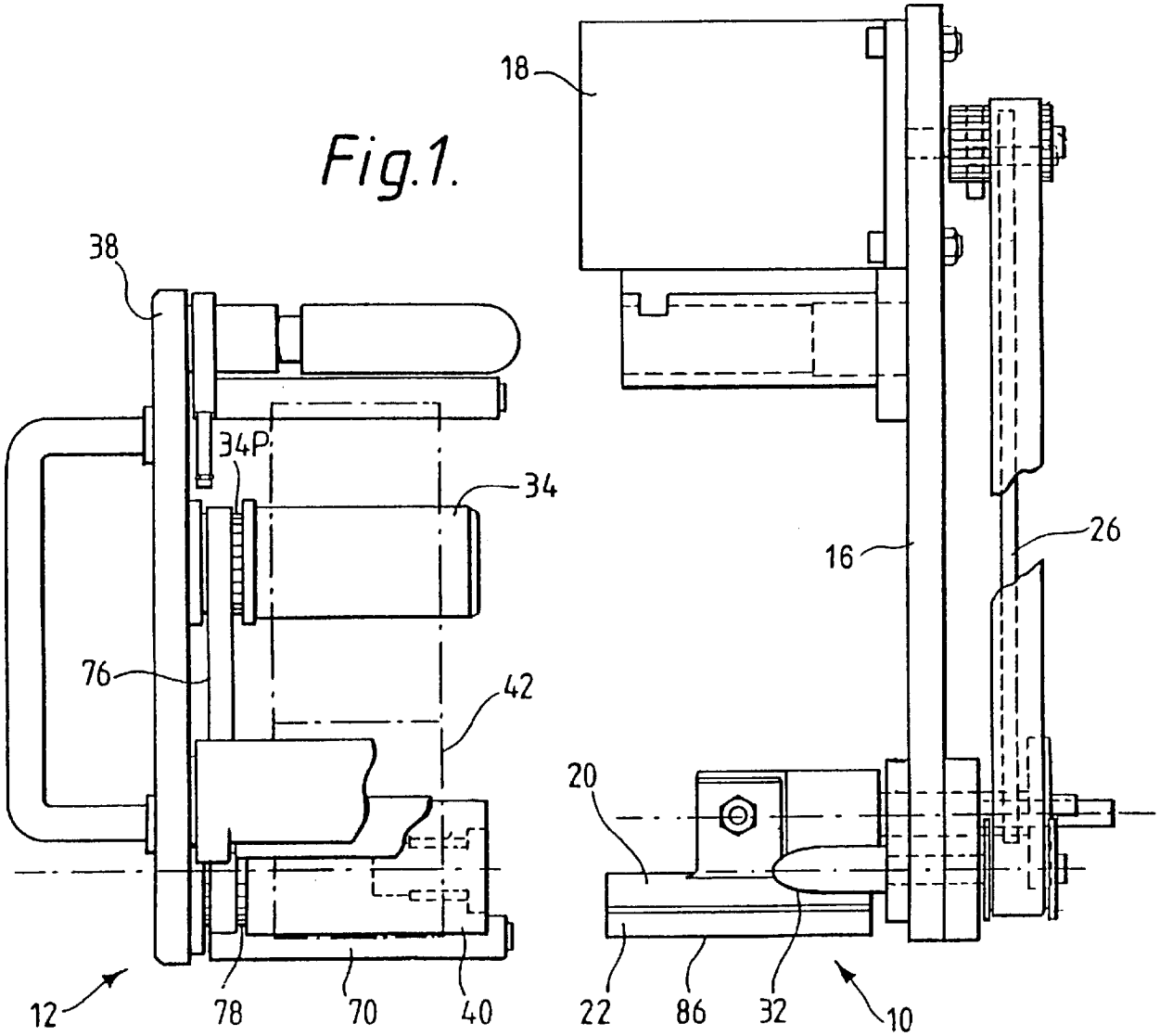
FIG. 1 is a diagrammatic exploded side view of a printer in accordance with the invention.
Figure 2:
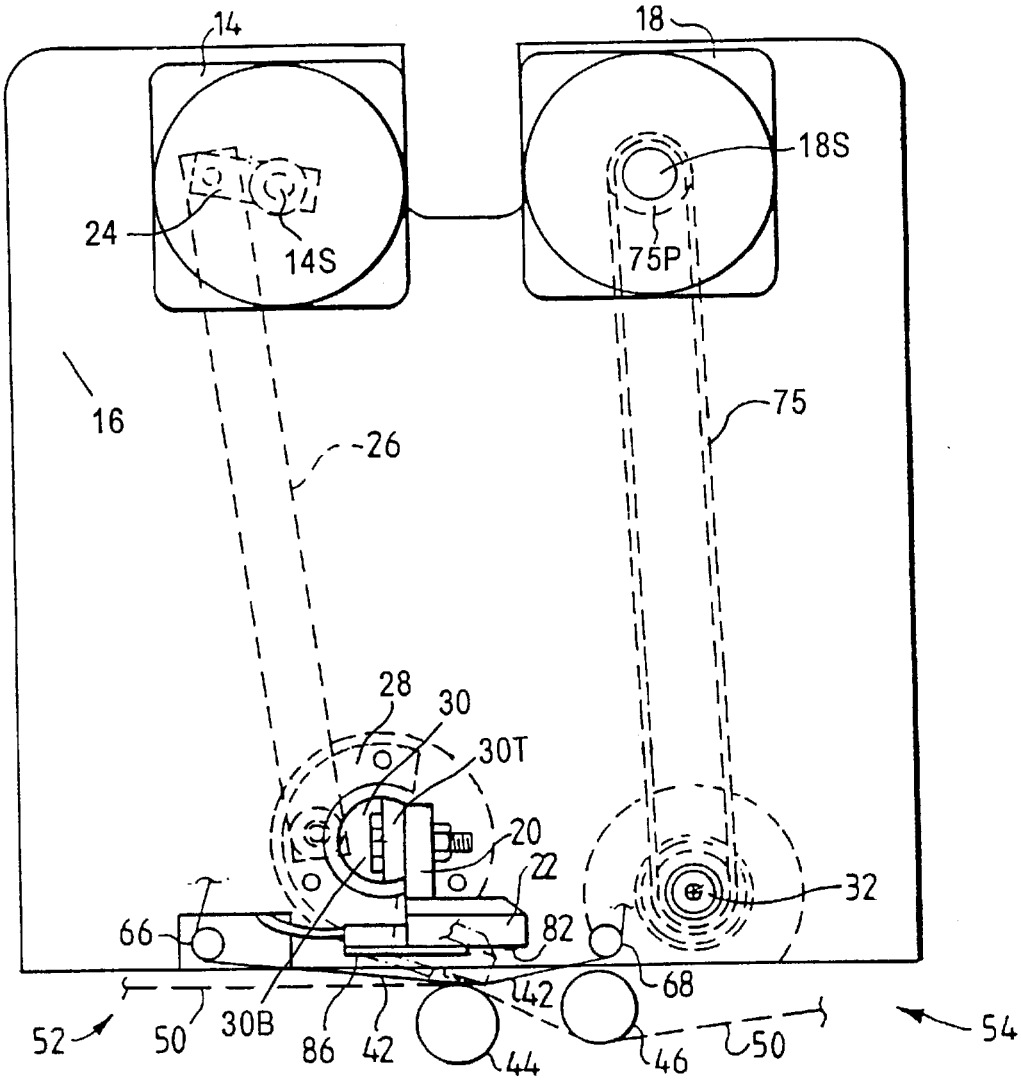
FIG. 2 is a front view of a base unit printer of FIG. 1.
Figure 3:
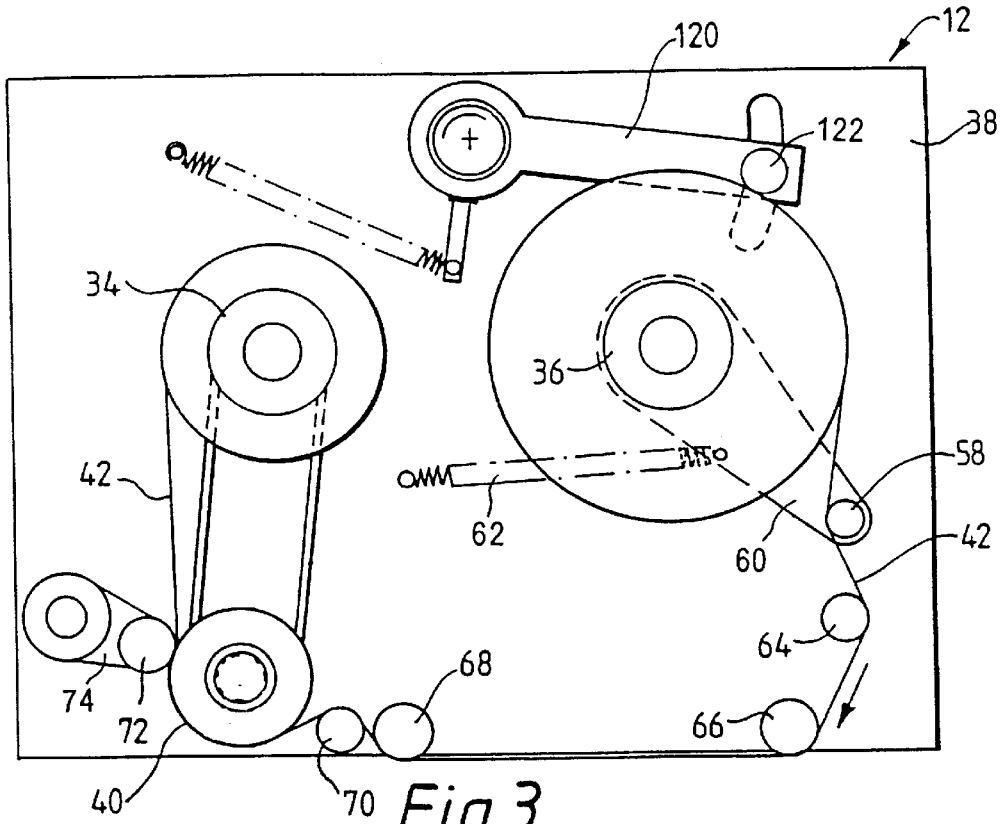
FIG. 3 is a rear view of a ribbon cassette of the printer of FIG. 1.

Referring to FIGS. 1, 2 and 3 together, a printer for the continuous printing of a continuous print medium by transfer from a thermal transfer print ribbon has a base unit 10 and a removable ribbon cassette unit 12. The base unit, which is mounted to a frame of the printer (not shown), contains a print head stepper motor 14 mounted on a front plate 16 of the unit 10, and a ribbon drive stepper motor 18 similarly mounted on the front plate 16. Coupled to the motor shaft 14S of the print head stepper motor 14 is a pivotable print head carrier 20 which supports a print head 22.

Coupling of the print head carrier 20 to the motor shaft 14S is by way of a parallelogram linkage lying behind the front plate 16 and comprising a first crank 24 fixed to the motor shaft 14S, a connecting link or rod 26, and a second crank 28 generally in the form of a semi-circular plate which is mounted on a shaft 30 supporting the print head carrier 20. Shaft 30 takes the form of a boss 30B on the front side of plate 16, with an axially extending tongue 30T to which the print head carrier 20 is bolted.

The motor shaft 18S of the ribbon drive stepper motor 18 is attached to a drive spindle 32 which, like the print head carrier 20, projects perpendicularly from the front plate 16 of the base unit 10.

For clarity, the cassette unit 12 is shown in FIG. 1 spaced from the base unit 10. In practice, when fitted to the base unit 10, the cassette unit 12 is closer to the base unit, such that ribbon spools 34, 36, which are rotatably mounted on a front plate 38 of the cassette unit 12, are coextensive with the print head 22 in terms of their location in a direction perpendicular to the front plate 38 of the cassette unit 12. Also attached to the cassette unit front plate 38 is a ribbon drive roller 40 visible in FIG. 1 below ribbon spool 34, and also in FIG. 3.

The relative positioning of the ribbon spools 34, 36, the print head 22, and the ribbon drive roller 40 may be ascertained by comparison of FIG. 1 with FIG. 3. The ribbon 42 itself is shown in full lines in FIG. 3, but in phantom lines in FIG. 1 for clarity. Certain items shown in FIG. 1 are not shown in FIG. 2, and vice versa In particular, a platen roller 44 and a deflection roller 46 are shown in FIG. 2 but not in FIGS. 1 and 3. These components are mounted on the printer frame or other apparatus which the printer is associated.

Referring to FIG. 2, continuous film material to be printed (shown by reference numeral 50) enters the printer in an inlet region 52, passes over and wraps around platen roller 44 from where it follows a downwardly inclined path to pass underneath and wrap around a deflection roller 46 before passing to an outlet region 54 of the printer. The positioning of platen and deflection rollers 44 and 46 is such that the film substrate 50 is nowhere deflected through an angle greater than 60° by any one guiding element, and preferably not greater than 45°. The function of the deflection roller 46 may be performed instead by any deflecting support for the film substrate 50 positioned to cause the substrate to be wrapped partly around the platen roller. Both platen roller 44 and deflection roller 46 have axes of rotation which extend at right angles to the direction of travel of the substrate film 50, and both axes are fixed in position so that the path of the substrate film 50 remains substantially constant during and between successive printing operations. As a result, the instantaneous rate at which the film 50 passes over the platen 44 always matches the rate at which it is supplied to and extracted from the printer through the inlet and outlet regions 52 and 54.

The thermal transfer ribbon 42 follows a ribbon path as follows. Firstly, a supply of the ribbon is provided on a feed spool 36 which is mounted by means of a bearing (not shown) fixed to the cassette unit front plate 38. A degree of friction is built into this bearing to maintain tension in ribbon 42. From spool 36, the ribbon 42 passes over a break detector roller 58 attached to the end of a break detector arm 60 which is rotatable about the rotation axis of the feed spool 36 and biased in a clockwise direction as seen in FIG. 3 by a spring 62. From roller 58, the ribbon 42 passes over guide rollers 64 and 66 attached to the cassette unit front plate 38 and thence through a region which, when the cassette unit 12 is loaded into the base unit 10, lies between the print head 22 and the platen 44. The ribbon then passes over a further guide roller 68. The head and the platen are seen in FIG. 2, as are also guide rollers 66 to 68, so that the location of the ribbon path relative to the head and platen can be seen. Where the ribbon 42 passes over platen 44 it is in frictional contact with the substrate film 50. The ribbon 42 is held in contact with substrate film 50 only between the start and finish of each printing operation, during which the lower surface of the print head 22 bears against the platen 44 through the ribbon 42 and film 50, as shown in FIG. 2. At other times, the print head 22 is raised by operation of its stepper motor 14.

From the print head 22, the ribbon 42 travels over guide roller 70 and is then wrapped around the drive roller 40. A pinch roller 72, mounted on a pivotable support arm 74, maintains the ribbon 42 in gripping contact with drive roller 40. Drive roller 40 has a rubber sleeve and is driven by motor 18 via a toothed belt 75 and toothed pulleys 75P behind base unit front plate 16 on the motor shaft 18S and the spindle 32, (shown in FIGS. 1 and 2) so that the ribbon 42 is pulled through the space between the print head 22 and the platen 44. From the drive roller 40, the ribbon 42 passes to take-up spool 34 which is belt-driven by a belt 76 from a pulley 78 (see FIG. 1) mounted on the shaft of drive roller 40. The mounting bearing (not shown) of the take-up spool 34 is mounted on a shaft fixed to the cassette unit front plate 38 and, like the mounting bearing of the feed spool 36, has a degree of friction built in. The diameter of the pulley 34P associated with take-up spool 34 together with the diameter of the pulley associated with drive roller 40 are such that the shaft bearing the take-up spool 34 is always driven faster than the speed of rotation necessary to take up the ribbon 42 from the drive roller 40, regardless of the diameter of the ribbon reel. The friction slip built into the connection between spool 34 and the belt-driven shaft allows the respective speeds of rotation of the drive roller 40 and the take-up spool 34 to be different from each other.

The print head 22 has side-facing printing elements 82 (FIG. 1) extending along a line parallel to the axis of rotation 84 of the print head carrier 20. These printing elements 82 project from a lower surface 86 of the print head 22 which, in the printing position of the print head 22 is tangential to the platen roller 44, as shown by the chain lines in FIG. 2. The arcuate locus followed by the line of printing elements 82 when the print head 22 is pivoted about axis 84 passes through the intersection of a tangent parallel to the print head lower surface 86 and the platen roller surface. Consequently, the ribbon 42 and the substrate film 50 are pinched between the print head 22 and the platen roller 44 precisely at the line of printing elements 82. When these elements are heated under electronic control, and the film 50 and ribbon 42 are passed together over the element, ink is transferred from the ribbon 42 to the film 50 to print characters and symbols according to pre-programmed information incorporated in the signals fed to the print head 22.

During printing, the ribbon 42 is in contact with film 50 and normally travels at the same speed. This is achieved by mounting an optical shaft encoder on a shaft bearing the platen roller 44. The output of the encoder (i.e. print medium speed sensor) is representative of the speed of the film 50, and by processing this output signal, the stepper motor 18 driving ribbon drive roller 40 is adjusted such that the ribbon is driven at the correct speed. This synchronisation between ribbon 42 and film 50 can be maintained over a wide range of speeds.

The preferred embodiment is capable of operating at a film speed of 400 mm per second.

Figure 4:
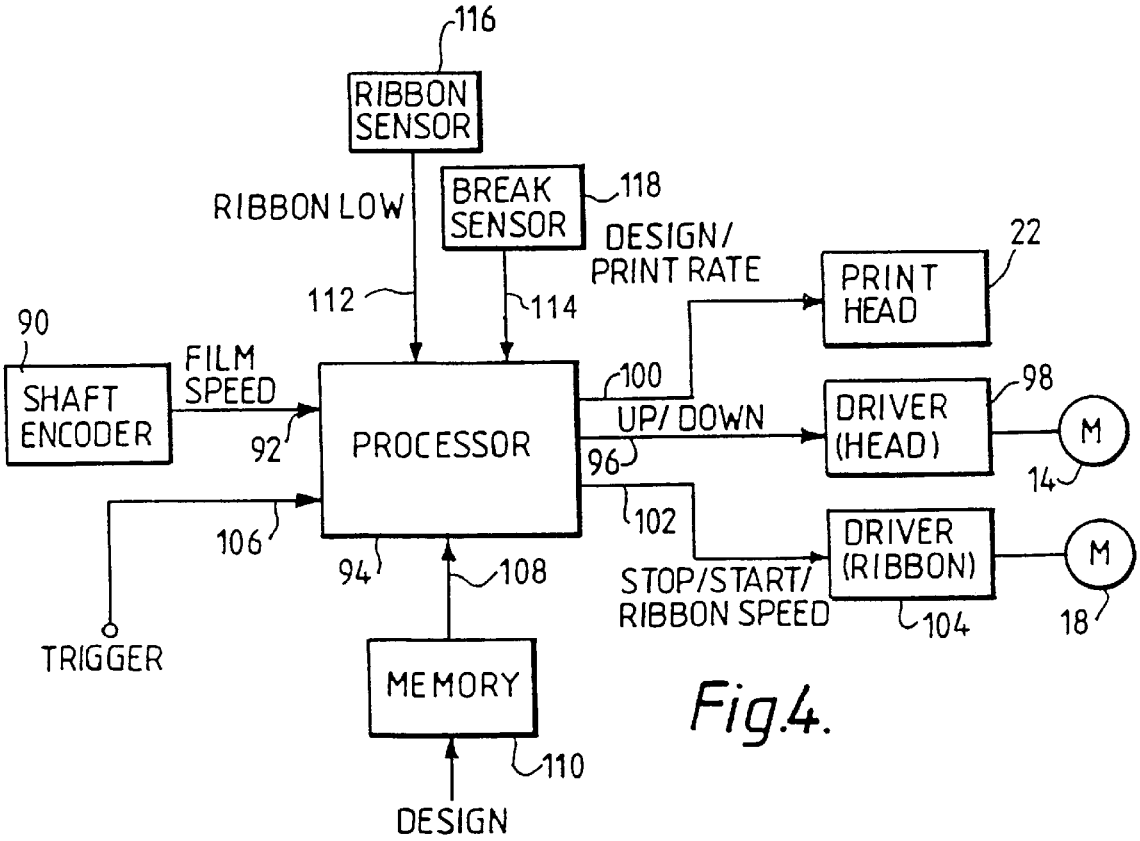
FIG. 4 is a block diagram of electrical parts of the printer.

The shaft encoder associated with the platen roller 44 is shown in FIG. 4 by reference numeral 90. Encoder 90 provides an input signal representative of film speed to an input 92 of a processor unit 94. The processor unit has at its heart a microprocessor, and has three outputs. These are a first output 96 coupled to a first motor driver circuit 98 for moving the print head between its inactive retracted position and its active extended position (respectively shown in FIG. 2) by means of stepper motor 14 and its associated linkage.

A second output of the processor unit 94 is a multi-wire input 100 coupled to the energisable elements 82 of the print head 22.

The third output 102 is coupled to a second motor driver 104 to control stepper motor 18, thereby stopping and starting the ribbon, and controlling the ribbon speed during each printing operation.

Other inputs to the processor include trigger input 106 which receives a trigger signal initiating each printing operation. Typically, the trigger signal is generated by sensing the position of products to which the substrate film is to be applied as packaging, as the products travel along an adjacent conveyer. Another input 108 receives the information to be printed from a memory 110. Thus, on receipt of a trigger signal at input 106, the processor is programmed as a printing actuator firstly to move the print head 22 to its extended position, to start the ribbon drive motor, and to initiate printing by energising the elements of the print head 22 in accordance with the information stored in the memory 1 10 thereby to print the information as a pattern or a series of characters.

Whilst the printing operation is progressing, the speed at which the ribbon is driven via driver 104 and motor 18 is determined according to the film speed signal input received by the processor at input 92, so as to drive the ribbon at the same speed as the film. The rate at which the print head elements are driven (i.e. the rate at which the pattern or characters are printed) is also varied by processor unit 94 according to the film speed signal input.

When the processor senses that all of the information relating to the required design has been supplied from memory 110 and has been fed to the print head 22, it issues a stop signal to the ribbon driver 104 to stop ribbon travel and the driver 98 for the print head motor 14 receives a signal causing the motor to withdraw the print head to its retracted, inactive position. Processor 94 then waits for the next trigger signal on 106 before repeating the above process.

Before the printing process is repeated, the motor 18 is driven in reverse to rewind a portion of the ribbon. The processor 94 waits a predetermined period of time after issuing the stop signal to the ribbon driver 104 to allow the ribbon and drive mechanism to decelerate. A reverse signal is then issued to the ribbon driver 104 to cause the motor 18 to step backwards by a predetermined number of steps.

In the printer's simplest embodiment, the predetermined number of steps is fixed and is equivalent to the rewinding of the minimum length of ribbon which overshoots the printing head after printing has stopped. This minimum length occurs when the printer is operating at its lowest printing speed (which means that the ribbon and drive mechanism are also operating at their lowest speed). However, greater ribbon savings can be made if the length of ribbon which is reversed is related to the forward speed of the ribbon during the previous printing operation.

Since the ribbon is driven under control of the processor 94, information on the forward speed of the ribbon is available within the processor 94 and the processor preferably adjusts the number of reverse steps which the ribbon driver 104 is instructed to drive the motor 18 depending on the forward speed of the ribbon during the previous printing operation. Generally, more ribbon will need to be rewound as the printer is operated at faster speeds. The relationship between the reversal length and the forward speed may be maintained using a lookup table or a calculation (mathematical or conditional) in software running on the processor 96.

Further inputs 1 12 and 1 14 of the processor 94 are called respectively to a ribbon status sensor 116 and a ribbon break sensor 118 which are respectively associated with a spring loaded pivotable arm 120, seen in FIG. 3. This arm 120 has a roller 122 at its distal end contacting the periphery of the ribbon supply on ribbon feed spool 36, so that when the ribbon supply runs low, an alarm can be activated and/or operation of the packaging apparatus of which the printer is part can be halted. Similarly, the break sensor 118 is responsive to excessive clockwise movement of arm 60 (see FIG. 3) to sense breakage of the ribbon 42 which, during normal operation, keeps roller 58 approximately in the position shown in FIG. 3.

Further details of the preferred printer in accordance with the invention will now be described. Limits on the movement of print carrier 20 and print head 22 are determined firstly by the striking of the print head elements 82 against the platen 44 (see FIG. 2) through the ribbon 42 and film 50, and, in the retractive position, by an adjustable stop (not shown) associated with the semi-circular plate 28 behind the front plate 16 of the base unit.

Figure 5:
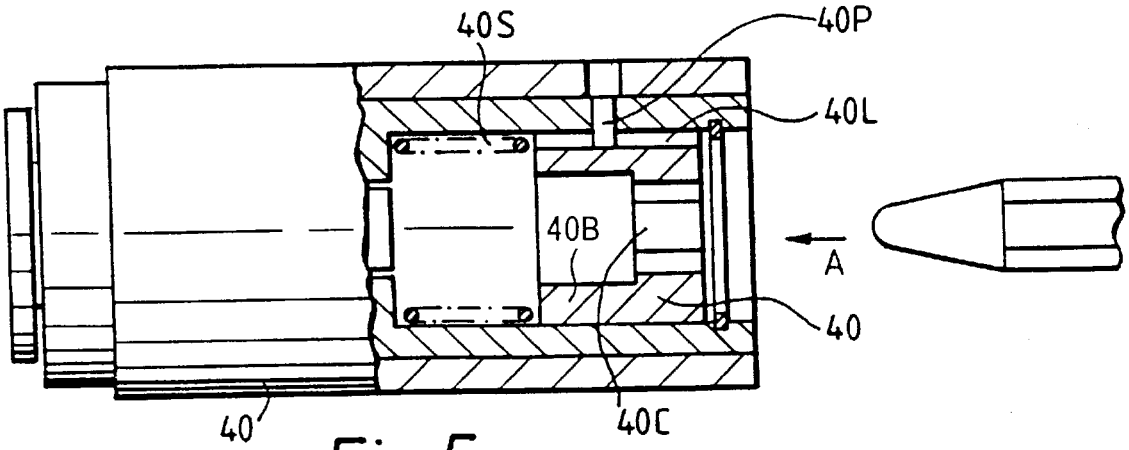
FIG. 5 is a plan view of a ribbon drive roller for the printer of FIG. 1.

Drive to the ribbon drive roller 40, which, it will be seen, is mounted on the cassette front plate 30, is transferred from the base unit 10 to the roller by means of drive spindle 32 shown in FIG. 1. Referring to FIG. 5, roller 40 contains a splined or multi-faced drive socket 40C. The socket 40C is formed in a sliding drive block 40B which is arranged to slide in the direction of arrow A. The block 40B is biased towards the right of the Figure by a coil spring 40S. When the cassette unit 12 is mounted on base unit 10, the splined or multi-faced drive shaft or spindle 32 attached to ribbon drive motor 18 (see FIG. 1) enters drive socket 40C (FIG. 3). The drive is transferred from spindle 32 to the bearing 40C and thence via pins 40P (engaged in elongate slots 40L formed in block 40B) to the roller 40.

The cassette unit 12 is located on base unit 10 by means of a retention pin 132 and a tubular socket 134, as shown in FIG. 1.

It is claimed:

1. A thermal printer for printing on a continuous print medium by ink transfer from a thermal print ribbon, comprising a print medium path structure between inlet and outlet regions of the printer, a platen extending transversely of said path, a thermal print head having energisable print elements and located in an opposing relationship with respect to the platen on the other side of the print medium path structure from the platen, a ribbon path structure which, between the print head and the platen, runs in the same direction as and lies adjacent the print medium path, a processor operable to bring the print head and the platen together in successive printing operations respectively achieved with successively adjacent areas of said ribbon, and a ribbon drive operable to drive the ribbon along the ribbon path in a first direction at variable rates during the printing operations, and being controlled by said processor to drive said ribbon between said successive printing operations in a second direction opposite to the first direction, wherein the ribbon drive is controlled by the processor to vary the length of ribbon driven in the second direction as a function of the speed of ribbon driving in the first direction.

2. A printer according to claim 1, further comprising a print medium speed sensor connected to said processor which receives a sensor output signal therefrom, and wherein the ribbon drive includes a ribbon drive roller connected to a motor, said processor having an output couples to the motor and being operable to drive the motor at a rate dependent on the sensor output signal.

3. A printer according to claim 2, wherein said processor includes a program operable to cause the motor to run at a rate which is dynamically variable during the printing operations in response to the sensor output signal.

4. A printer according to claim 2, wherein the sensor is a shaft encoder associated with a roller positioned with respect to the print medium path so as to be in contact with the print medium as it passes along the said path with the surface speed of the roller matching the speed of the print medium.

5. A printer according to claim 1, wherein the ribbon drive means is controlled by the processor to vary the length of ribbon driven in the second direction as a function of the speed of ribbon driving in the first direction.

6. A printer according to claim 1, wherein the ribbon drive is controlled by the processor to drive the ribbon at the same speed as the print medium.

7. A printer according to claim 1, wherein the print medium path is substantially fixed.

8. A printer according to claim 1, wherein the platen has a cylindrical surface and the print medium path defining means are arranged to cause the print medium to wrap around the said surface.

9. A printer according to claim 8, wherein the platen is a roller and wherein the print medium path include a print medium deflector parallel to and adjacent the platen to cause the print medium to wrap around the platen.

10. A printer according to claim 1, wherein the platen is fixed in position and further including means for moving the print head towards and away from the platen in response to operation of said processor.

11. A printer according to claim 10, wherein the print head is mounted in a print head carrier, and wherein the printer further comprises a motor coupled to the print head carrier and operable to drive the carrier and the head in an oscillating motion.

12. A printer according to claim 10, wherein the print head is mounted on a print head carrier which is pivotable about an axis running transversely to the print medium path, the print elements being spaced from the said transverse axis to execute the movement towards and away from the platen and to follow an arcuate locus intersecting the platen.

13. A printer according to claim 12, including a stepper motor coupled to the print head carrier for pivoting the print head carrier about the transverse axis, the print head being moved towards and away from the platen at the start and finish respectively of each printing operation.

14. A printer according to claim 1, including a print medium speed sensor, the printing actuator being responsive to an output from the speed sensor.

15. A printer according to claim 13, wherein the sensor is a shaft encoder operatively connected with a roller positioned with respect to the print medium path so as to be in contact with the print medium as it passes along the said path with the surface speed of the roller matching the speed of the print medium.

16. A method of printing on a continuous print medium, comprising providing a printer having a print head with energisable print elements, and a platen, the print head and the platen being located in an opposing relationship with respect to each other, feeding the print medium to the printer at a continuous feed rate and passing it between the print head and the platen in the same direction as and adjacent the print medium, feeding a print ribbon between the print head and the platen, and periodically bringing the print head and the platen together and energising the print elements with the ribbon in contact with the print medium to cause transfer of ink from the ribbon to the print medium in a printing operation, wherein the print medium is passed between the print head and the platen at a rate corresponding to the rate at which the print medium is fed to the printer during and between successive printing operations wherein, during each printing operation, the ribbon is passed in a first direction between the print head and the platen in contact with the print medium, the rate at which the ribbon moves during the printing operation being variable in response to the rate of travel of the print medium in the printer and wherein the ribbon is moved in a second direction which is the reverse of the first direction, between printing operations; and wherein the length of ribbon moved in the second direction is varied according to the speed of ribbon movement in the first direction.

17. A printer for printing on a continuous print medium by ink transfer from a print ribbon, comprising a print medium path structure, a platen extending transversely of the path, a print head having energisable print elements and located in an opposing relationship with the platen on the other side of the print medium path from the platen, a ribbon path structure which, between the print head and the platen, runs parallel with and lies adjacent the print medium path, a ribbon take-off spool, a ribbon take-up spool which is belt driven with a belt via a slipping clutch drive, a reversible ribbon drive and a printing actuator operable to bring the print head and the platen together in successive printing operations, said reversible ribbon drive being reversible in incremental amounts corresponding to a distance in which the ribbon overshoots the print head between said successive printing operations.

18. A printer according to claim 17, further comprising a ribbon drive pulley located in the ribbon path between the print head and the take-up spool, and a ribbon drive motor coupled to the drive pulley.

* * * * *